US006499747B2

(12) United States Patent
Fagan

(10) Patent No.: US 6,499,747 B2
(45) Date of Patent: Dec. 31, 2002

(54) ROCKING CYCLE

(76) Inventor: Joseph S. Fagan, 3435 Grey Farm Rd., Jamesville, NC (US) 27846

( * ) Notice: Subject to any disclaimer, the term of this patent is extended or adjusted under 35 U.S.C. 154(b) by 0 days.

(21) Appl. No.: 09/963,392

(22) Filed: Sep. 27, 2001

(65) Prior Publication Data

US 2002/0125653 A1 Sep. 12, 2002

Related U.S. Application Data

(60) Provisional application No. 60/273,635, filed on Mar. 7, 2001.

(51) Int. Cl.[7] ..... A63G 19/14; A63G 17/00; B62M 3/00

(52) U.S. Cl. ..... 280/1.207; 280/1.191; 280/1.208; 280/255; 280/258; 280/264

(58) Field of Search ..... 280/1.189, 1.191, 280/1.207, 1.208, 226.1, 233, 255, 258, 264

(56) References Cited

U.S. PATENT DOCUMENTS

| | | | | |
|---|---|---|---|---|
| ,222,861 A | | 12/1879 | Brasch | |
| 1,338,545 A | | 4/1920 | Winnek | |
| 1,347,099 A | | 7/1920 | Howes | |
| 2,136,752 A | | 11/1938 | Neilson | |
| 2,252,156 A | | 8/1941 | Bell | |
| 2,252,995 A | | 8/1941 | Thomas | |
| 2,259,987 A | * | 10/1941 | Bailie | 280/1.189 |
| 2,424,632 A | | 7/1947 | Powlick | |
| 2,454,656 A | | 11/1948 | Kollman | |
| 2,770,463 A | | 11/1956 | Battaglia et al. | |
| 2,837,342 A | | 6/1958 | Kirk | |
| 2,986,405 A | | 5/1961 | Spratt | |
| 3,074,731 A | | 1/1963 | Jenne | |
| 4,553,766 A | | 11/1985 | Liu | |
| 5,120,074 A | | 6/1992 | Herman et al. | |
| 5,538,270 A | * | 7/1996 | Gajek et al. | 280/264 |
| 5,549,313 A | | 8/1996 | James et al. | |

* cited by examiner

*Primary Examiner*—Daniel G. DePumpo
*Assistant Examiner*—Matthew Luby
(74) *Attorney, Agent, or Firm*—Birch, Stewart, Kolasch & Birch, LLP

(57) ABSTRACT

The present invention relates to a manually powered vehicle, such as a child's ride-on toy. The vehicle is powered by a rocking, or up-and-down, motion of the rider. The rocking motion is mechanically translated into a force for propelling the ride-on vehicle via one or more ratcheting levers. The vehicle has two front, driven wheels and a single, rear steerable wheel.

20 Claims, 4 Drawing Sheets

ROCKING CYCLE

This application claims priority on Provisional Application No. 60/273,635 filed on Mar. 7, 2001, the entire contents of which are hereby incorporated by reference.

BACKGROUND OF THE INVENTION

1. Field of the Invention

The present invention relates to a manually powered vehicle, such as a child's ride-on toy. More particularly, the present invention concerns a vehicle wherein a rocking, or up-and-down motion, of the rider is mechanically translated into a force for propelling the ride-on vehicle.

2. Description of the Relevant Art

Children's ride-on toys, which translate a rocking, or up-and-down motion, of the child into a force for propelling the ride-on toy are generally known in the existing arts. However, the ride-on toys of the background art suffer drawbacks.

For example, U.S. Pat. No. 222,861 discloses a manually powered children's ride-on horse. FIGS. 9 and 10 depict the conventional ride-on horse. A child sits on a saddle (G) connected to a frame (F). The frame (F) is moveable relative to a chassis (A). The frame (F) is connected to a conventional pedal sprocket (D). A child's rocking motion is translated, via the moveable frame (F), to the sprocket (D), and causes the sprocket (D) to rotate. Therefore, the frame (F) must completely turn the sprocket (D) round and round, in order to drive the ride-on toy.

The conventional structure of FIGS. 9 and 10 works adequately, so long as the toy is driven on a flat surface and a sufficient speed is maintained in the forward progress of the ride-on toy. However, at slower speeds, such as when starting off, or when trying to climb a slope, it is often very difficult for a child to power the ride-on toy to make the ride-on toy move in the forward direction. Under these circumstances, stalls often occur, and the child needs a push to get the vehicle moving.

The stalls occur when the cranks (E) attaching the frame (F) to the sprocket (D) are at, or near, the twelve o'clock and six o'clock positions, as the sprocket (D) rotates. When the cranks (E) are so positioned, the forces applied by the frame (F) have little or no component values, which tend to cause a rotation of the sprocket (D). When stalls occur, the child or a supervising adult needs to push the ride-on toy for a short distance in order to move the cranks (E) off of the twelve o'clock and/or six o'clock positions.

Stalls can also occur when the ride-on toy is first mounted for riding. In the unfortunate event that the ride-on toy happens to have its cranks (E) initially located at the twelve and six o'clock positions, the child will be unable to start the ride-on toy's forward progress by rocking the saddle (G), and must manually push the ride-on toy a short distance before rocking movement will power the ride-on toy to move. Stalling is an annoyance and inconvenience to the child or supervising adult. In fact, the annoyance can take the fin out of riding the ride-on toy, and make the toy undesirable to the child.

A second drawback of the rocking ride-on toys of the conventional arts is that steering often occurs at the front wheels. Front wheel steering of a rocking type ride-on toy can lead to dangerous circumstances. Since the child, is repeating a pattern of shifting their weight down onto the front axle, and then immediately pulling up on the front axle, the front axle is unstable. Traction, and hence steering, is affected and can be erratic, leading to the child driving the ride-on toy into obstacles. Front steering can also lead to a tip-over and injury to the child, if the front wheels are cut or turned to sharply. A tip-over is especially likely if only a single front steerable wheel is provided, as illustrated in FIGS. 9 and 10.

A third drawback of many of the rocking ride-on toys of the background art is the provision of four wheels. Four wheels, while providing added stability, increase the overall size of the ride-on toy, and thereby limit the areas in which the ride-on toy can be driven. Further, four wheels relative to three wheels increase the rolling resistant and weight of the ride-on toy, thus requiring additional power to drive the toy. This limits the class of children who are physically able to enjoy the ride-on toy.

SUMMARY OF THE INVENTION

It is therefore an object of the present invention, to provide a ride-on vehicle which is resistant to stalling at slow speeds; is resistant to stalling when initially starting out; is stable in its steering; and is designed to have a reduced rolling resistance.

It is also an object of the present invention to provide a ride-on vehicle that is logical in design, and thereby easy and economical to manufacture, maintain, and repair.

Other objects and further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein.

DETAILED DESCRIPTION OF THE INVENTION

Figure 1:
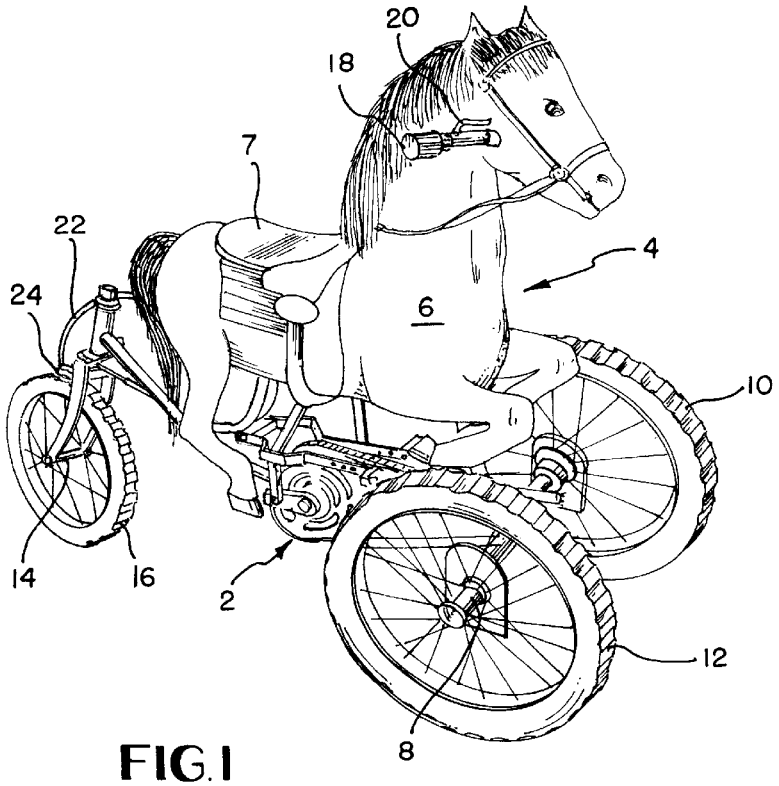
FIG. 1 is a perspective view of a ride-on vehicle, in accordance with the present invention.

FIG. 1 depicts a ride-on vehicle, in accordance with the present invention. The ride-on vehicle includes a lower chassis 2 and an upper frame 4. The frame 4 is moveably attached to the chassis 2. The frame 4 may pivot, or more preferably rock, relative to the chassis 2.

A body 6 covers the frame 4. The body 6 presents an exterior shape or configuration, which resembles any animate or inanimate object desirable or interesting to a child. For example, the exterior shape may be a horse, zebra, unicorn, dragon, space creature, bird, lizard, insect, car, motorcycle, tank, robot, etc. In FIG. 1, the exterior shape is illustrated as a horse. A saddle 7 is provided on the body 6. The saddle 7 is provided to support the weight of the rider.

The chassis 2 supports a first axle 8. A first wheel 10 and a second wheel 12 are attached to opposed ends of the first axle 8. The chassis 2 also supports a second axle 14. A third wheel 16 is attached to the second axle 14. The first axle 8 is located forward of the second axle 14, relative to a normal travel direction of the vehicle.

A manual steering member is moveable attached to the frame 4. The manual steering member, such as handlebars 18, extend outside of the body 6. The handlebars 18 may be gripped by a rider and rotated to the right or left to change the travel direction of the vehicle. The handlebars 18 could be manually replaced by other steering members such as a harness.

A brake actuator, such as a brake lever 20, is attached to the handlebars 18. A brake linkage 22 connects the brake lever 20 to a brake 24 attached to the chassis 2 proximate the third wheel 16 (see FIG. 8). Activation of the brake lever 20 causes pads of the brake 24 to engage a rim of the third wheel 16 to slow or stop rotation of the third wheel 16.

Figure 2:
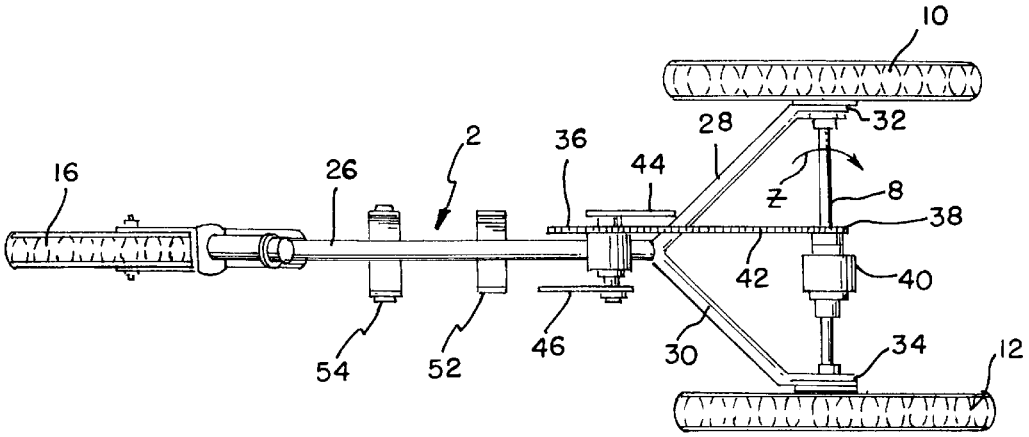
FIG. 2 is an overhead view of a chassis of the ride-on vehicle.

Now, with reference to FIG. 2, a structure of the chassis 2 will be disclosed. The chassis 2 includes a central pipe 26. A first axle support pipe 28 and a second axle support pipe 30 branches from the central pipe 26. The first and second axle support pipes 28, 30 support the first axle 8, via first and second bearings 32, 34, respectively. The first and second wheels 10, 12 are connected proximate to opposite ends of the first axle 8.

A main drive member, such as a main sprocket 36 is rotatably attached proximate a mid portion of the central pipe 26. The main sprocket 36 can be rotatably supported by needle or roller bearings, as conventional bicycle pedal sprockets are supported. A driven member, such as a driven sprocket 38, is attached to a differential 40. The differential 40 is attached to the first axle 8.

The driven sprocket 38 is connected to the main sprocket 36 by a chain 42. Rotation of the main sprocket 36 causes rotation of the driven sprocket 38, via the chain 42. Rotation of the driven sprocket 38 in a first direction, indicated by Z in FIG. 2, causes the differential 40 to rotate the first axle 8 in the first direction Z. Rotation of the first axle 8 in the first direction Z causes rotation of the first and second wheels 10, 12 in the first direction Z and thereby causes forward movement of the vehicle.

Coasting of the vehicle is permitted via the differential 40. If the rotation speed of the first axle 8 is greater than the rotation speed of the driven sprocket 38 (or if the driven sprocket 38 is not rotating at all), the differential 40 will allow the first axle 8 to rotate free of the driven sprocket 38. Such differentials are known in the art. Further, the differential 40 may have a 1:1 ratio, or any other suitable or desired ratio in translating the rotation of the driven sprocket 38 to the first axle 8.

Figure 3:
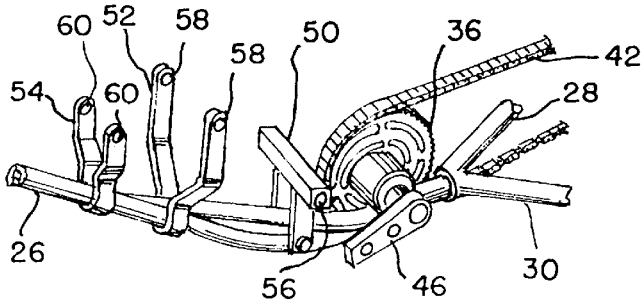
FIG. 3 is a side view of a middle portion of the chassis.

With reference to FIGS. 2 and 3, a first ratcheting lever 44 is attached to one side of the main sprocket 36. A second ratcheting lever 46 is attached to an opposite side of the main sprocket 36. The first ratcheting lever 44 extends in a first angular direction, whereas the second ratcheting lever 46 extends in a second angular direction, which is displaced approximately one hundred and eighty degrees relative to the first angular direction.

The first ratcheting lever 44 is configured to transmit a torque tending to rotate the main sprocket 36, when the first ratcheting lever 44 is rotated clockwise (as viewed in FIG. 3). The first ratcheting lever 44 would not transmit a torque tending to rotate the main sprocket 36, when the first ratcheting lever 44 is rotate counter clockwise (as viewed in FIG. 3). Similarly, the second ratcheting lever 46 is configured to transmit a torque tending to rotate the main sprocket 36, when the second ratcheting lever 46 is rotated clockwise (as viewed in FIG. 3). The second ratcheting lever 46 would not transmit a torque tending to rotate the main sprocket 36, when the second ratcheting lever 46 is rotated counter clockwise (as viewed in FIG. 3).

The inner construction of the first and second ratcheting levers 44, 46 is known in the unrelated art of hand tools. For example, a box-end ratcheting wrench would function in a similar manner. If utilizing box-end wrenches, the first ratcheting lever 44 would be set to loosen a bolt and ratchet in the tightening direction, whereas the second ratcheting lever 46 would be set to tighten a bolt and ratchet in the loosening direction.

FIG. 3 illustrates an upstanding T-support member 50, a first cradle 52 and a second cradle 54 attached to the central pipe 26 of the chassis 2. The T-support member 50 includes mounting holes 56. The first cradle 52 includes mounting holes 58. The second cradle 54 includes mounting holes 60. The T-support 50, first cradle 52 and second cradle 54 are used to support the moveable frame 4, as will be further described below.

Figure 4:
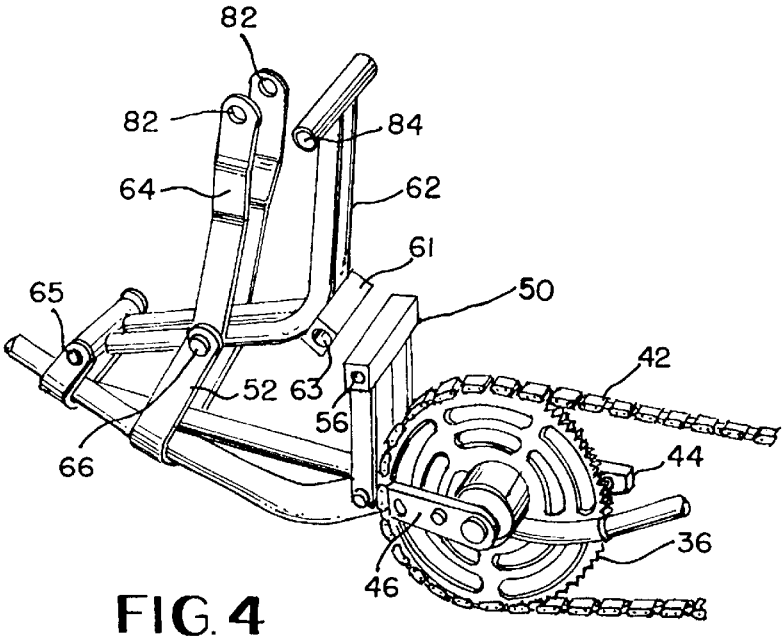
FIG. 4 is a side view, similar to FIG. 3, illustrating frame components attached to the chassis.

FIG. 4 illustrates the attachment of several frame components to the chassis 2. An L-shaped central lattice 62 is attached to the second cradle 54. The L-shaped central lattice 62 is attached via a pair of bolt/nuts 65 engaged within the mounting holes 60 of the second cradle 54. The L-shaped central lattice 62 includes a block 61 attached proximate its mid, curved portion. The block 61 includes mounting holes 63.

A pair of upstanding, bowed out links 64 are attached to the first cradle 52. The pair of bowed out links 64 are attached via a pair of bolt/nuts 66 engaged within the mounting holes 58 of the first cradle 52. The L-shaped central lattice 62 passes between the bowed out links 64, such that the block 61 is located forward of the bowed out links 64.

Figure 5:
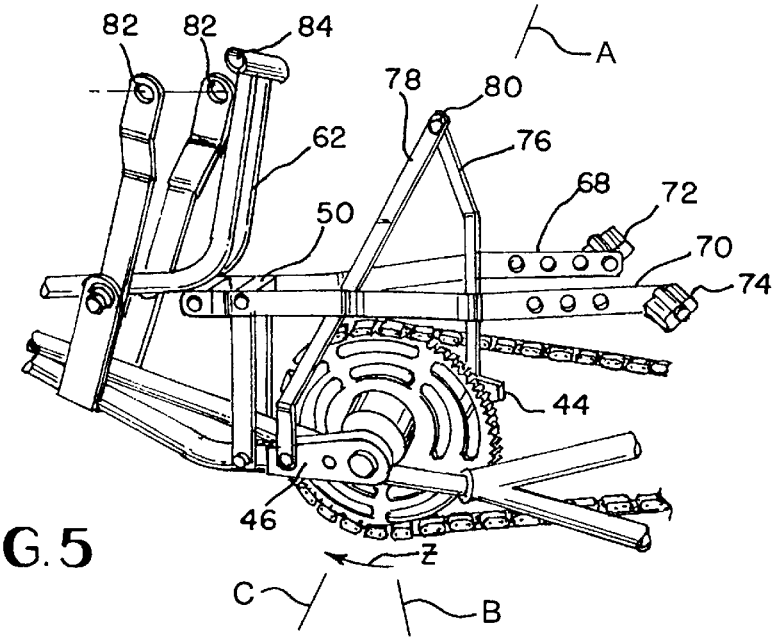
FIG. 5 is side view, similar to FIG. 4, illustrating additional frame components attached to the chassis.

FIG. 5 illustrates a first pedal link 68 and a second pedal link 70 attached to the previously disclosed frame components. The first pedal link 68 has a proximal end attached to one of the mounting holes 63 of the block 61. The first pedal link 68 is also attached to one of the mounting holes 56 of the T-support member 50. Finally, a first stirrup or pedal 72 is attached to a distal end of the first pedal link 68. The attachments of the first pedal link 68 to the block 61 and the T-support member 50 are pivotal attachments, such that as the first pedal 72 moves downward, the L-shaped central lattice 62 is elevated, and as the L-shaped central lattice 62 moves downward the first pedal 72 is elevated.

The second pedal link 70 has a proximal end attached to one of the mounting holes 63 of the block 61. The second pedal link 70 is also attached to one of the mounting holes 56 if the T-support member 50. Finally, a second stirrup or pedal 74 is attached to a distal end of the second pedal link 70. The attachments of the second pedal link 70 to the block 61 and the T-support member 50 are pivotal attachments, such that as the second pedal 74 moves downward, the L-shaped central lattice 62 is elevated, and as the L-shaped central lattice 62 moves downward the second pedal 74 is elevated.

FIG. 5 also illustrates a first ratchet linkage 76 and a second ratchet linkage 78. The first ratchet linkage 76 has a first end pivotally connected to the first ratcheting lever 44. The second ratchet linkage 78 has a first end pivotally connected to the second ratcheting lever 46. Second ends of the first and second ratchet linkages 76, 78 are pivotally connected together by a pin 80.

As illustrated in FIGS. 4 and 5, upper ends of the bowed out links 64 have first connection holes 82. Further, an upper end of the L-shaped central lattice 62 has a second connection hole 84. The first connection holes 82, the second connection hole 84 and the pin 80 are pivotally attached to an under frame, which is rigidly attached to inside surfaces of the body 6. The pivotally attachments may be by bolt and nut combinations.

Figure 6:
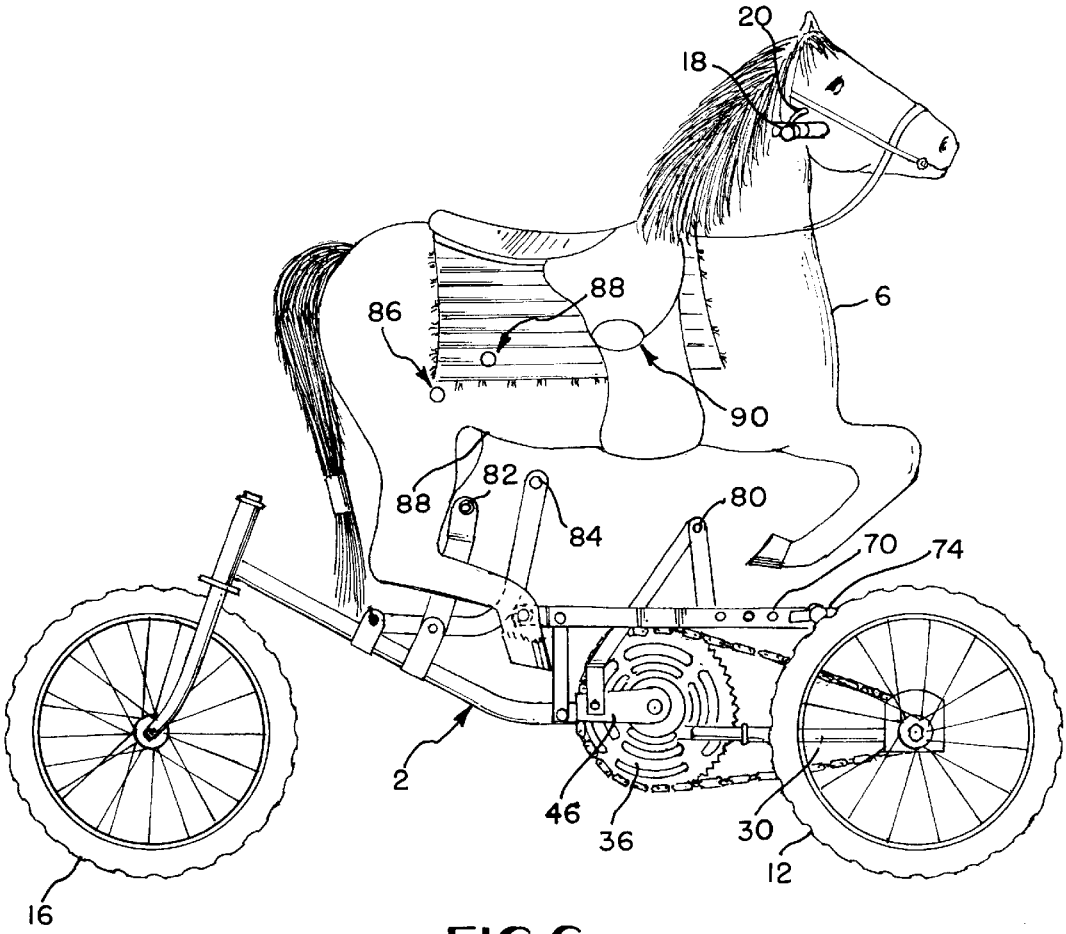
FIG. 6 is a side view of a body placed over the frame.

FIG. 6 is a side view illustrating the body 6 being lowered onto the frame 4. When assembled, the first connection holes 82 would reside in a region 86 inside the body 6. The second connection hole 84 would reside in a region 88 inside of the body 6. Further, the pin 80 would reside in a region 90 inside of the body 6. Since the under frame of the body 6 is pivotally connected to the bowed out links 64, the L-shaped central lattice 62, and the pin 80, the frame 4 may move relative to the chassis 2. The frame's movement is more than a simple pivoting action. Rather, the movement is a more complex rocking action, wherein a pivot axis translates or moves as the frame 4 rocks relative to the chassis 2. This complex rocking action more accurately imitates the bucking of a horse or animal, much more so than a simple scissors-type movement.

When riding the vehicle, a rider sits on the saddle 7 and rests their feet on the first and second pedals 72, 74. The riders pull up on the handlebars 18 and presses down on the first and second pedals 72, 74. This action tends to increase the distance between the first and second pedals 72, 74 relative to the handlebars 18, by pulling the handlebars 18 and pushing the pedals 72, 74. This is a very natural motion to the rider.

Next, the rider stops pulling up on the handlebars 18 and stops pushing down on the pedals 72, 74. The rider simply rests their weight on the saddle 7. Again, this is very simple motion. The rider's weight on the saddle 7 will tend to lower the handlebars 18 and raise the pedals 72, 74. Now, the vehicle is in a state to repeat the pulling and pushing motions of the rider. By repeating the above actions, the frame 4 rocks on the chassis 2 and the rider can cause the vehicle to begin its forward motion, and can accelerate the forward motion of the vehicle.

From a mechanical standpoint, the rocking of the frame 4 relative to the chassis 2 causes the first and second ratchet linkages 76, 78 to move the first and second ratcheting levers 44, 46. When the body 6 rocks downward, the first ratcheting lever 44 drives the main sprocket 36 to rotate in the first direction Z, while the second ratcheting lever 46 exhibits a ratcheting action. When the body 6 rocks upward, the second ratcheting lever 46 drives the main sprocket 36 to rotate in the first direction Z, while the first ratcheting lever 44 exhibits a ratcheting action. The main sprocket 36 rotates the driven sprocket 38 via the chain 42. Thereby causing movement of the vehicle.

It is important to note that the first ratcheting lever 44 operates in a range, which does not include the twelve or six o'clock positions. For example, when view from the right-hand side of the vehicle (FIG. 5), the first ratcheting lever 44 could operate between the one o'clock (A) and five o'clock (B) positions. The second ratcheting lever 46 also operates in a range, which does not include the twelve or six o'clock positions. For example, viewed from the right-hand side of the vehicle (FIG. 5), the second ratcheting lever 46 could operate between the seven o'clock (C) and eleven o'clock (D) positions.

It can be appreciated from a study of the drawings that the first and second ratcheting levers 44, 46 are arranged in a mirror symmetrical relationship relative to the main sprocket 36. For example, when the first ratcheting lever 44 is at the one o'clock position, the second ratcheting lever 46 is at the eleven o'clock position; when the first ratcheting lever 44 is at the three o'clock position, the second ratcheting lever 46 is at the nine o'clock position; and when the first ratcheting lever 44 is at the four o'clock position, the second ratcheting lever 46 is at the eight o'clock position.

During riding, when the rider releases their weight from the pedals 74, 76, and allows their weight to rest upon the saddle 7 of the body 6, the first ratcheting lever 44 is driven downward (in a clockwise direction in FIG. 5) and causes the main sprocket 36 to rotate. At the same time the second ratcheting lever 46 is also driven downward (in a counterclockwise direction in FIG. 5). However, the second ratcheting lever 46 "clicks" or exhibits a ratcheting action and does not act to drive the main sprocket 36.

When the rider pushes against the pedals 74, 76 with their feet and pulls up on the handle bars 18 using arm strength, the first ratcheting lever 44 is driven upwards (counterclockwise in FIG. 5) and the second ratcheting lever 46 is also driven upwards (clockwise in FIG. 5). The second ratcheting lever 46 drives the main sprocket 36 to rotate, while the first ratcheting lever 44 "clicks" or exhibits a ratcheting action and does not act to drive the main sprocket 36.

As one can see, rocking of the frame 4 causes the first and second ratcheting levers 44, 46 to alternatively drive the main sprocket 36 always in the first direction Z (clockwise in FIG. 5). Of course, the ratcheting directions of the first and second ratcheting levers 44, 46 may be reversed if desired. Further, the operation ranges of the first and second ratcheting levers 44, 46 could be modified. For example, the second ratcheting lever 46 could operate between the eight o'clock to eleven o'clock positions, and the first ratcheting lever 44 could operate between the one o'clock to four o'clock positions.

The drive system of the present invention is quite advantageous relative to the prior art, since the problem of stall is eliminated. The first and second ratcheting levers 44, 46 never reach the twelve or six o'clock positions, whereat the force components would be ineffective in rotating the main sprocket 36.

Figure 7:
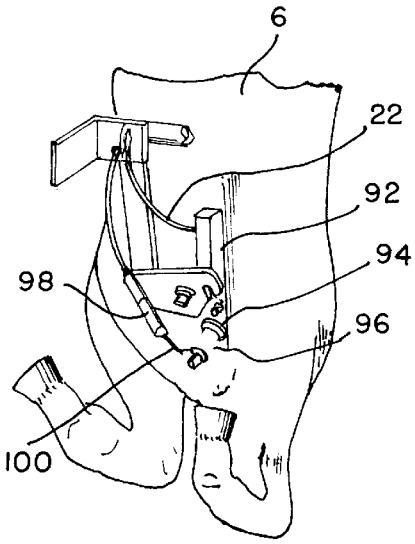
FIG. 7 is bottom view of the front of the body illustrating steering components.

FIG. 7 is a bottom view of a forward portion of the body 6. An end portion 92 of the under frame of the body 6 projects toward the forward most portion of the body 6. The end portion 92 holds a forward collar 94. A lower end of a stem 96 is rotatably supported by the forward collar 94. The stem 96 projects upward, and the handlebars 18 are connected to an upper end of the stem 96. Rotating the handlebars 18 causes the stem 96 to rotate within the forward collar 94.

A cable has an outer sleeve 98 attached to the end portion 92 of the under frame. A cable has an inner wire 100 that extends out of the outer sleeve 98. The inner wire 100 is attached to an outer perimeter of the stem 96, such that rotation of the stem 96 causes the inner wire 100 to retract into or extend out of the outer sleeve 98.

Figure 8:
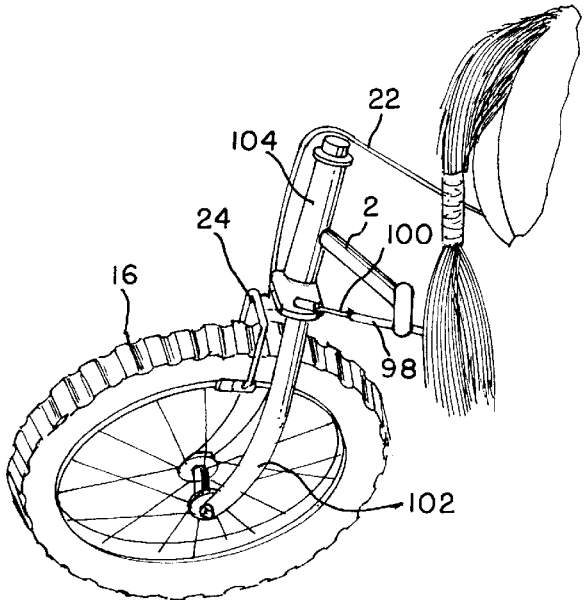
FIG. 8 is a perspective view of steering components attached to a rear steerable wheel.
Figure 9:
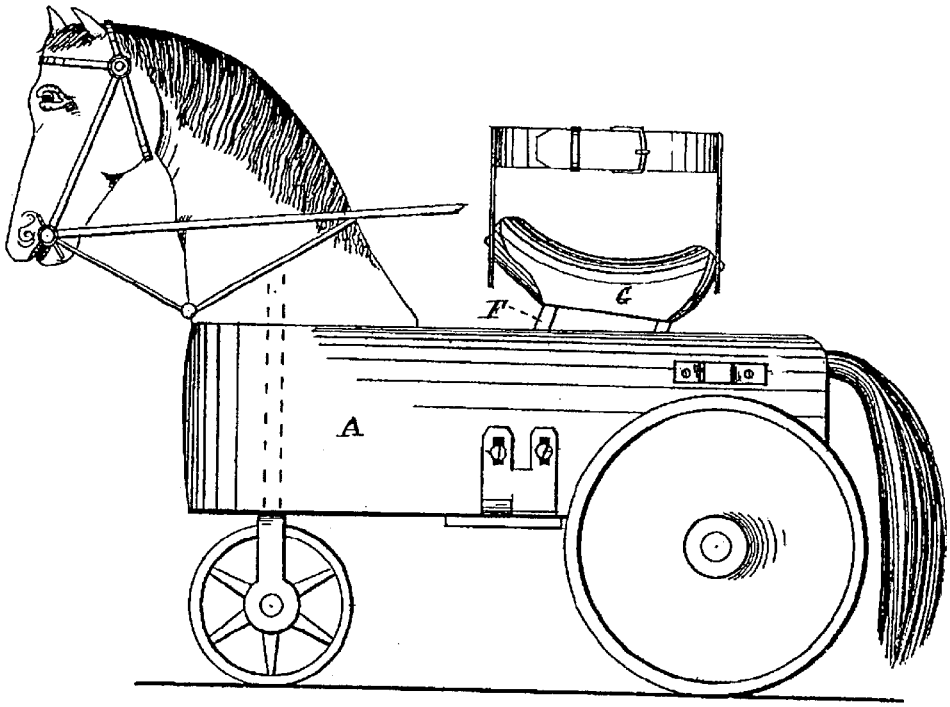
FIGURE 9 CONVENTIONAL ART
FIG. 9 is a side view of a conventional ride-on toy.
Figure 10:
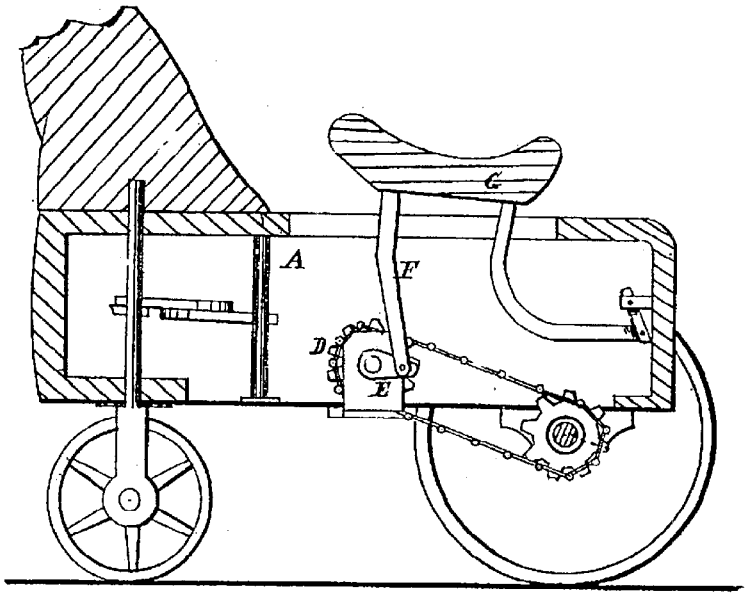
FIGURE 10 CONVENTIONAL ART
FIG. 10 is a cross sectional view of the conventional ride-on toy of FIG. 9.

FIG. 8 is a perspective view of the third wheel 16. An opposite end of the cable reaches proximate to the third wheel 16. The opposite end of the cable has the outer sleeve 98 connected to the chassis 2. The inner wire 100 is connected to a fork 102. The fork 102 is rotatably supported by a rearward collar 104. Movement of the inner wire 100 into and out of the outer sleeve 98 causes rotation of the fork 102 in the rearward collar 104, and hence steering of the third wheel 16.

By providing two wheels up front and a single wheel in the rear of the vehicle, the present invention provides a vehicle that has a reduced rolling resistance and a small footprint. The small footprint enables the vehicle to be stored in a relatively smaller space and driven in a relatively smaller area. Further, by providing the steering at the rear wheel, the vehicle of the present invention is resistant to tipping over when the turning radius is small. Further, steering is easier, since only a single wheel need be turned as compared to turning two wheels. Further, rear steering is desirable in combination with the rocking propulsion system, since the rocking motion present at the front, first axle 8 has little effect on the steering transpiring at the rear, second axle 14.

It is important to note that the handlebars 18 are connected to the under frame of the body 6. Therefore, the handlebars 18 move in unison with the rocking motion of the frame 4 relative to the chassis 2. This provides a more comfortable and natural feeling to the riding of the vehicle.

The present invention has been described using one specific example, however the present invention is subject to modification. For example, although the specification and drawings disclose "pipes" in the chassis 2 and frame 4, the members constituting the chassis 2 and frame 4 could be in any configuration, such as square or triangular cross sections. Further, the pipes could be dual pipes. In fact, FIGS. 3 and 4 illustrate a doubling of the central pipe 26 in the region of the main sprocket 36, so as to reinforce the central pipe 26 in that area.

Although the drawings illustrate first and second ratchet linkages 76, 78 and first and second ratcheting levers 44, 46, more or less linkages and levers could be provided to cause rotation of the main sprocket 36. Further, the main sprocket 36, driven sprocket 38, and chain 42 could be replaced by similar systems, such as a main pulley, a driven pulley, and a belt. Alternatively, the main sprocket 36 could be directly engaged to the driven sprocket 38 (e.g., as intermeshed gearing), thereby eliminating the need for the chain 42. Of course, the locations and numbers of pivots between the chassis 2, the frame 4 and/or the body 6 may be varied while remaining within the spirit and scope of the present invention.

Although terms such as "toy," "child" and "children" have been used above in describing the present invention, it should be understood that these terms are specific only to one embodiment of the present invention. The present invention has, as another embodiment, a ride-vehicle for adults. Such a ride-on vehicle would serve as an exercise device and/or as a fun and unique transportation vehicle for sidewalk travel, bike trails, etc.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. A manually powered vehicle comprising:

a chassis;

a first axle connected to said chassis;

at least one wheel connected to said first axle;

a main drive member rotatably fixed to said chassis;

a driven member connected to at least one of said first axle and said at least one wheel, wherein rotation of said main drive member relative to said chassis causes rotation of said driven member;

a frame movably connected to said chassis; and at least one ratcheting lever connected to said main drive member, wherein movement of said frame relative to said chassis causes said at least one ratcheting lever to rotate said main drive member relative to said chassis and causes said at least one wheel to rotate to move said vehicle, wherein movement of said frame relative to said chassis in a first direction causes said at least one ratcheting lever to rotate said main drive member, and wherein movement of said frame relative to said chassis in a second direction, opposite to said first direction, causes said at least one ratcheting lever to spin freely relative to said main drive member, such that said main drive member may rotate free, relative to said at least one ratcheting lever.

2. The vehicle according to claim 1, further comprising:

a link connecting said at least one ratcheting lever to said frame.

3. The vehicle according to claim 1, wherein said at least one ratcheting lever includes a first ratcheting lever and a second ratcheting lever, and further comprising:

a first link connecting said first ratcheting lever to said frame; and a second link connecting said second ratcheting lever to said frame.

4. The vehicle according to claim 3, wherein said first ratcheting lever extends away from said main drive member in a first angular direction, and wherein said second ratcheting lever extends away from said main drive member in a second angular direction which is displaced from said first angular direction.

5. The vehicle according to claim 1, wherein said main drive member is a first sprocket; and wherein said driven member is a second sprocket, and further comprising:

a drive chain connecting said first sprocket and said second sprocket.

6. The vehicle according to claim 1, further comprising:

a saddle portion connected to said frame, said saddle portion for supporting a weight of a rider.

7. The vehicle according to claim 6, further comprising:

an outer body attached to said frame, said outer body including said saddle portion, wherein said outer body has a shape of a horse.

8. The vehicle according to claim 1, wherein said at least one wheel includes a first wheel and a second wheel connected to said first axle, and wherein said driven member is connected to said first axle and causes said first axle to rotate and thereby to rotate said first and second wheels.

9. The vehicle according to claim 8, further comprising:

a second axle connected to said chassis; and a third wheel connected to said second axle.

10. The vehicle according to claim 9, further comprising:

a manual steering member moveably connected to one of said frame and said chassis; and a linkage connecting said steering member to said third wheel, such that said third wheel is steerable to direct said vehicle.

11. The vehicle according to claim 10, further comprising:

a brake activator attached to said manual steering member; and a brake proximate said third wheel for slowing or stopping said third wheel, in response to said brake activator.

12. A manually powered vehicle comprising:

a chassis;

a first axle connected to said chassis;

a second axle connected to said chassis;

first and second wheels connected to said first axle;

a third wheel connected to said second axle;

a main drive member rotatably fixed to said chassis;

a driven member connected to said first axle, wherein rotation of said main drive member relative to said chassis causes rotation of said driven member which causes said first axle to rotate to thereby rotate said first and second wheels;

a frame movably connected to said chassis, wherein movement of said frame relative to said chassis causes rotation of said main drive member relative to said chassis and hence causes said first and second wheels to rotate to move said vehicle;

a manual steering member moveably connected to one of said frame and said chassis; and a linkage connecting said steering member to said third wheel, such that said third wheel is steerable to direct said vehicle.

13. The vehicle according to claim 12, wherein said manual steering member is connected to said frame.

14. The vehicle according to claim 13, further comprising:

a brake activator attached to said manual steering member; and a brake proximate said third wheel for slowing or stopping said third wheel, in response to said brake activator.

15. The vehicle according to claim 12, further comprising:

a saddle portion connected to said frame, said saddle portion for supporting a weight of a rider.

16. The vehicle according to claim 15, further comprising:

an outer body attached to said frame, said outer body including said saddle portion, wherein said outer body has a shape of a horse.

17. The vehicle according to claim 12, further comprising:

at least one ratcheting lever connected to said main drive member, wherein movement of said frame relative to said chassis causes said at least one ratcheting lever to rotate said main drive member relative to said chassis.

18. The vehicle according to claim 17, wherein said at least one ratcheting lever includes a first ratcheting lever extending away from said main drive member in a first angular direction, and a second ratcheting lever extending away from said main drive member in a second angular direction which is displaced from said first angular direction.

19. A manually powered vehicle comprising:

a chassis;

a first axle connected to said chassis;

at least one wheel connected to said first axle;

a main drive member rotatably fixed to said chassis;

a driven member connected to at least one of said first axle and said at least one wheel, wherein rotation of said main drive member relative to said chassis causes rotation of said driven member;

a frame movably connected to said chassis;

at least one ratcheting lever connected to said main drive member, wherein movement of said frame relative to said chassis causes said at least one ratcheting lever to rotate said main drive member relative to said chassis and causes said at least one wheel to rotate to move said vehicle; and a link connecting said at least one ratcheting lever to said frame.

20. The vehicle according to claim 19, further comprising:

a saddle portion connected to said frame, said saddle portion for supporting a weight of a rider.

* * * * *